US005702331A

United States Patent [19]

Perham

[11] Patent Number: 5,702,331

[45] Date of Patent: Dec. 30, 1997

[54] NON-GRIPPING HAND/FOOT RESISTANCE PRODUCING AQUATIC EXERCISE APPARATUS AND METHOD OF USE

[76] Inventor: Christine M. Perham, 4600 N. Kain #40, Tucson, Ariz. 85705

[21] Appl. No.: 721,607

[22] Filed: Sep. 26, 1996

[51] Int. Cl.[6] ..... A63B 21/008

[52] U.S. Cl. ..... 482/111; 482/112; 441/129

[58] Field of Search ..... 482/111, 112; 441/80, 88, 125, 129

[56] References Cited

U.S. PATENT DOCUMENTS

| | | | |
|---|---|---|---|
| 3,427,022 | 2/1969 | Ward | 272/80 |
| 3,604,033 | 9/1971 | Lino | 441/88 |
| 3,756,592 | 9/1973 | Johnson | 272/57 |
| 4,300,759 | 11/1981 | Caplan | 272/116 |
| 4,458,896 | 7/1984 | Solloway | 272/116 |
| 4,671,507 | 6/1987 | Huttner | 482/11 |
| 4,768,774 | 9/1988 | Beasley | 272/1 B |
| 4,836,814 | 6/1989 | Bambara | 441/65 |
| 4,861,300 | 8/1989 | Casagrande et al. | 441/81 |
| 4,936,804 | 6/1990 | Dowdeswell | 441/6 |
| 4,982,745 | 1/1991 | Shields | 128/877 |
| 5,184,993 | 2/1993 | Dowdeswell | 482/106 |
| 5,203,753 | 4/1993 | Rothhammer | 482/111 |
| 5,520,561 | 5/1996 | Langenohl | 441/129 |

FOREIGN PATENT DOCUMENTS

| | | | |
|---|---|---|---|
| 13630 | 6/1911 | United Kingdom | 441/88 |
| 2030871 | 4/1980 | United Kingdom | 273/67 R |

*Primary Examiner*—Richard J. Apley
*Assistant Examiner*—Denise Pothier

[57] ABSTRACT

A buoyant body shaped substantially as a short, flexible, columnar buoyant body, constructed from polyethylene expanded foam material having a coloring substance added to produce a colored buoyant body to enhance their use, and to facilitate color coordination with an exerciser's swimwear. The buoyant body includes a port for receiving a hand, or foot, appropriately for the particular device to be used. The port is provided centrally positioned on the buoyant body, and defines a cavity, sized for receiving the exerciser's hand or foot in a relaxed and extended manner, and thus facilitates a non-gripping securement and grip-free manipulation of the buoyant body to produce resistance in a water exercising environment. For a hand manipulated buoyant body, the defined cavity is a rectangular shaped, tapered through-hole that dimensionally conforms to the tapered shape of a hand from finger tips to beyond the knuckles and part of the palm without including the thumb. The fit is snug and relaxed without an exerciser having to exert a gripping force on the buoyant body while manipulating the buoyant body. The feel to the hand during use is a snug, relaxed, and secure feeling, and reflects a compressed deformation of the pliable foam material. The feel to the foot for a corresponding buoyant body is substantially the same.

15 Claims, 1 Drawing Sheet

NON-GRIPPING HAND/FOOT RESISTANCE PRODUCING AQUATIC EXERCISE APPARATUS AND METHOD OF USE

FIELD OF THE INVENTION

The present invention relates to aquatic exercise equipment. More particularly, the present invention relates to resistance producing aquatic exercise equipment. Even more particularly, the present invention relates to the structural portion of aquatic exercise equipment used for holding the equipment employing the hands or feet.

DESCRIPTION OF THE PRIOR ART

The aquatic exercise equipment of the present invention relates to hand and feet manipulated flotation devices that also provide varying degrees of resistance to a person using them during a water aerobics workout. Known water aerobics workout equipment that also provide varying degrees of resistance are the water aerobic dumbbell devices. A particular drawback of the dumbbell devices is that they require a user to concentrate on the task of gripping the bar interconnecting the opposing dumbbells during their use. There are several known prior art patents concerning aquatic exercise devices. Included are barbell type devices such as taught by U.S. Pat. Nos. 4,458,896, 5,184,993 and 5,203,753, and other hand grip based type of exercising devices as taught by U.S. Pat. Nos. 3,427,022, 3,756,592, 4,300,759, and 4,768,774. U.S. Pat. Nos. 4,861,300 and 5,520,561 are of general interest in the field. The teachings of U.S. Pat. No. 3,427,022 are noteworthy in that the handle opening is claimed as conforming to the contour of a body portion being inserted into the handle opening and that the buoyant body may be a hollow air-tight object, or may be of solid construction and of shapes other than spherical. The 3,427,022 patent teaches the handle opening depending and being spaced from the outer surface of the buoyant object. Further, the handle taught by the 3,427,022 patent requires grasping by the hand as is evident by the thickness of the handle member as illustrated in FIG. 4.

During a resistance producing aquatic exercise session with the known prior art devices, the gripping action elevates the blood pressure which is counter productive to the benefits of exercising in water, which benefits include a lower heart beat during an exercise session. Further, although foot worn aquatic exercise equipment that produce resistance are known, their construction comprise an arrangement of straps, or are constructed as taught by the 3,427,022 patent. Thus, a need is seen to exist for aquatic exercise equipment that can easily be manipulated by a person in water to produce a resistance without the exerciser having to exert a gripping force on the body.

It is therefore a primary object of this invention to provide a buoyant body aquatic exercise equipment that can be easily manipulated by a person in water to produce a resistance without the exerciser having to exert a gripping force on the body.

SUMMARY OF THE INVENTION

Accordingly, the foregoing objects are accomplished by providing a geometrically shaped, buoyant body shaped substantially as a short, flexible, columnar buoyant body (measuring 8 to 12 inches in length and having a diameter of four (4) to six (6) inches), constructed from polyethylene expanded foam material. The substantially short, flexible, columnar, buoyant body preferably comprises closed cell foam material having a coloring substance added to produce a colored buoyant body to enhance their use, and to facilitate color coordination with an exerciser's swimwear. The primary structure of the present invention comprises a port for receiving a terminal part of a human's limb. The centrally provided port being centrally positioned on the buoyant body, and which port defines a cavity, sized for receiving the exerciser's terminal part, and for facilitating a non-gripping act of securement of the buoyant body to enable a grip-free manipulation of said buoyant body to produce resistance in a water exercising environment. By example, the terminal parts contemplated for being inserted in the port being selected from a group of human limb terminal parts including the hand and foot. Separate buoyant body embodiments being used for the hand and foot aquatic exercise applications. Thus, a columnar, buoyant body designed for producing resistance during a foot related aquatic exercise being sized larger than a columnar, buoyant body designed for producing resistance during a hand related aquatic exercise. Further, the defined cavity comprises a rectangular shaped, tapered through-hole sized such that a height dimension associated with an entry side is larger than a height dimension associated with an exit side of said through-hole. The height of the entry side and exit side of the cavity being sized larger for the buoyant body designed for a foot related aquatic exercise, than the entry side and exit side of the cavity of a columnar, buoyant body designed for a hand related aquatic exercise. For a hand related aquatic exercise buoyant body, the tapering through-hole through the columnar buoyant body dimensionally conforms to the tapered shape of a hand from finger tips to beyond the knuckles and part of the palm without including the thumb without having to exert a gripping force on the buoyant body. The feel to the hand during use is a snug, relaxed, and secure feeling, and reflects a compressed deformation of the pliable foam material. The feel to the foot for a corresponding buoyant body is substantially the same.

By example, in a water aerobic setting for producing resistance using the hands, a person would utilize a pair of the buoyant bodies by inserting their respective portions of their hands through the port and perform a variety of exercise routines that make use of the resistance of the buoyant bodies. Securement of the buoyant bodies does not require a gripping action by the exerciser and results in a more relaxed water aerobics session. Other geometrical body shapes are possible so long as there is symmetry and distribution of resistance during use, eg. a 4×4 inch square pliable foam block having a hand entry port would be a shape consistent with the columnar shaped buoyant body discussed above.

Therefore, to the accomplishments of the foregoing object, the invention consists of the foregoing features hereinafter fully described and particularly pointed out in the claims, the accompanying drawings and the following disclosure describing in detail the invention, such drawings and disclosure illustrating but one of the various ways in which the invention may be practiced.

DESCRIPTION OF THE PREFERRED EMBODIMENT OF THE INVENTION

Figure 1:
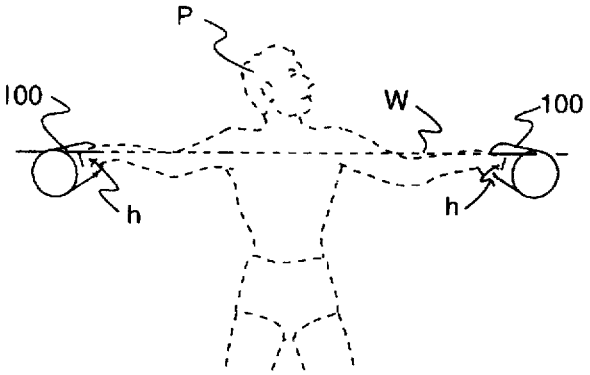
FIG. 1 is a perspective view of a pair of aquatic exercise resistance bars, in accordance with the present invention, shown being used by inserting the hands into the aquatic exercise bar's tapered holding port.
Figure 1A:
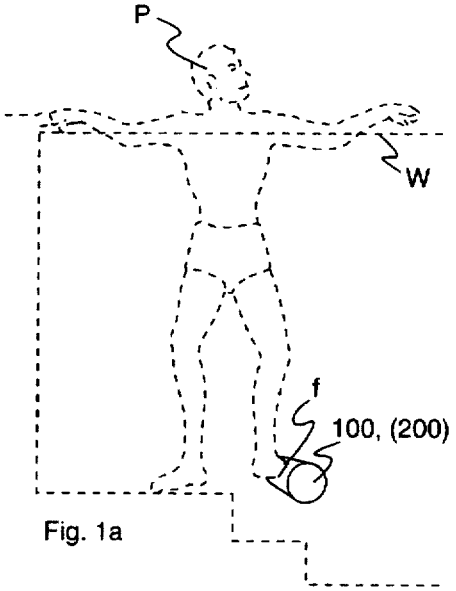
FIG. 1*a* is a perspective view of a single aquatic exercise resistance bar, in accordance with the present invention, shown being used by inserting a user's foot into the aquatic exercise bar's tapered holding port.
Figure 2:
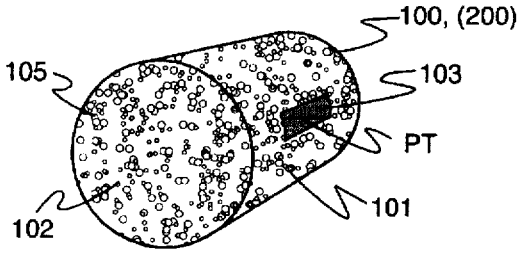
FIG. 2 shows a perspective view of the present invention showing the entry side of the tapered holding port in accordance with the present invention.
Figure 3:
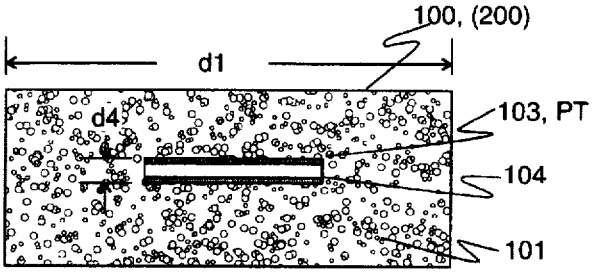
FIG. 3 shows a front elevation view of the present invention showing the tapered holding port as viewed from the entry side, in accordance with the present invention.
Figure 5:
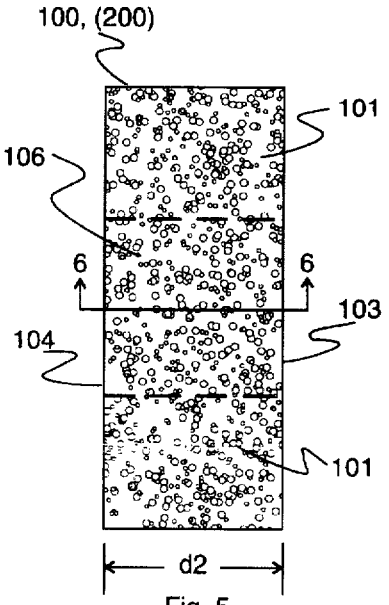
FIG. 5 shows a top view of the present invention showing in broken lines the outline of the tapered holding port, in accordance with the present invention.
Figure 4:
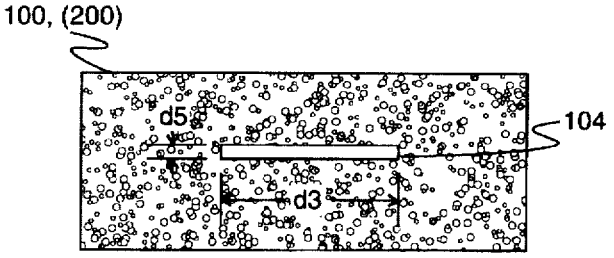
FIG. 4 shows a rear elevation view of the present invention showing the tapered holding port as viewed from the exit side, in accordance with the present invention.
Figure 6:
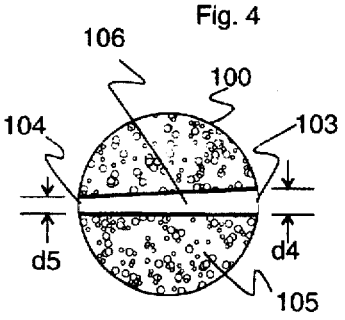
FIG. 6 is a cross section view taken along line 6—6 in FIG. 5 showing the tapered holding port, in accordance with the present invention.

FIGS. 1 and 1*a* show the present invention being used by a person P in a water exercising environment W as hand and foot aquatic exercise buoyant body apparatus 100, 200, respectively. Aquatic exercise apparatus 100, 200 comprise buoyant bodies formed from polyethylene expanded foam material 105, also known as crosslink polyethylene foam which may be colored to add an aesthetic appeal to the equipment for color coordinating with the person's swimwear. FIG. 2 shows a perspective view of aquatic exercise apparatus 100, 200 showing the entry side 103 of the tapered through-hole port PT for receiving either a hand h or foot f. The buoyant bodies 100, 200 are preferably shaped substantially as a short, flexible, cylindrical buoyant body 101, measuring in the range of eight (8) to twelve (12) inches in length d1, and having ends 102 with a diameter d2 in the range of four (4) to six (6) inches). Thus, a buoyant body 200 for the feet being sized larger than a buoyant body 100 for the hands. Referring now to FIGS. 3–6, port PT is shown as being centrally positioned on the buoyant body 101, and defines a cavity 106, sized for receiving an exerciser's hand h, or foot f, depending on which buoyant body 100, 200 is selected. Accordingly, in the preferred embodiment, the defined cavity 106 comprises a rectangular shaped, tapered through-hole, sized having a width d3 and a height dimension d4, d5, such that height d4 associated with entry side 103, is larger than a height dimension d5, associated with exit side 104 of through-hole port PT. The height of the entry side 103 and exit side 104 of cavity 106 being sized larger for buoyant body 200 than the entry side 103 and exit side 104 of the cavity 106 of buoyant body 100. The through-hole port PT, 106 facilitates a non-gripping action for securing apparatus 100, 200 during an aquatic exercise session, resulting in a grip-free manipulation of the buoyant body 100, 200 to produce resistance in a water exercising environment. As discussed previously, for a hand related aquatic exercise, such as shown in FIG. 1, the tapering through-hole 106 through the buoyant body 100 dimensionally conforms to the tapered shape of a hand from finger tips to beyond the knuckles and part of the palm without including the thumb. This fit is snug and relaxed without an exerciser having to exert a gripping force on the buoyant body while manipulating the buoyant body.

The method of producing resistance by an exerciser while exercising in an aquatic environment W using aquatic exercise equipment without exerting a gripping force on said aquatic exercise equipment, comprises the steps of: (a) providing at least one, resistance producing aquatic exercise apparatus 100, (200), in accordance with the present invention; (b) selecting either apparatus 100 or 200 and preparing to exercise in the aquatic environment W using either the hand or foot; (d) inserting the hand or foot, depending upon which apparatus has been selected; and once in the water environment with apparatus 100 (200) positioned in a relaxed and extended manner, the exerciser begins (e) producing resistance by manipulating apparatus 100 (200) in the water.

Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus.

I claim:

1. A resistance producing aquatic exercise apparatus, said apparatus comprising:

a geometrically shaped, buoyant body; and a port for receiving a terminal part of a human's limb, said port being centrally positioned on said buoyant body, said port defining a cavity sized for receiving the said terminal part and facilitating a non-gripping securement of said buoyant body by an exerciser to enable a grip-free, resisted manipulation of said buoyant body in a water exercising environment, said geometrically shaped, buoyant body comprising a substantially short, flexible, columnar, buoyant body constructed from polyethylene expanded foam material, said columnar, buoyant body being sized larger when the terminal part is a foot than when the terminal part is a hand, and said cavity comprises a rectangular shaped, tapered through-hole sized such that a height dimension associated with an entry side is larger than a height dimension associated with an exit side of said through-hole.

2. A resistance producing aquatic exercise apparatus as described in claim 1, wherein:

said tapered through-hole being sized such that an exerciser's hand may be received therein.

3. A resistance producing aquatic exercise apparatus as described in claim 2, wherein:

said substantially short, flexible columnar buoyant body further comprises said polyethylene expanded foam material having a coloring substance added to produce a colored, substantially short, flexible, columnar, buoyant body.

4. A resistance producing aquatic exercise apparatus as described in claim 1, wherein:

said tapered through-hole being sized such that an exerciser's foot may be received therein.

5. A resistance producing aquatic exercise apparatus as described in claim 4, wherein:

said substantially short, flexible columnar buoyant body further comprises said polyethylene expanded foam material having a coloring substance added to produce a colored, substantially short, flexible, columnar, buoyant body.

6. A resistance producing aquatic exercise apparatus, said apparatus comprising:

a geometrically shaped, buoyant body; and a port for receiving a terminal part of a human's limb, said port being centrally positioned on said buoyant body, said port defining a cavity sized for receiving the terminal part and facilitating a non-gripping securement of said buoyant body by an exerciser to enable a grip-free, resisted manipulation of said buoyant body in a water exercising environment, said cavity comprises a rectangular shaped, tapered through-hole sized such that a height dimension associated with an entry side is larger than a height dimension associated with an exit side of said through-hole.

7. A resistance producing aquatic exercise apparatus as described in claim 6, wherein:

said tapered through-hole being sized such that an exerciser's hand may be received therein.

8. A resistance producing aquatic exercise apparatus as described in claim 7, wherein:

said geometrically shaped, buoyant body comprises a substantially short, flexible, columnar, buoyant body constructed from polyethylene expanded foam material, said substantially short, flexible columnar buoyant body further comprises said polyethylene expanded foam material having a coloring substance added to produce a colored, substantially short, flexible, columnar, buoyant body.

9. A resistance producing aquatic exercise apparatus as described in claim 6, wherein:

said tapered through-hole being sized such that an exerciser's foot may be received therein.

10. A resistance producing aquatic exercise apparatus as described in claim 9, wherein:

said geometrically shaped, buoyant body comprises a substantially short, flexible, columnar, buoyant body constructed from polyethylene expanded foam material, said substantially short, flexible columnar buoyant body further comprises said polyethylene expanded foam material having a coloring substance added to produce a colored, substantially short, flexible, columnar, buoyant body.

11. A resistance producing aquatic exercise apparatus, said apparatus comprising:

a geometrically shaped, buoyant body, said geometrically shaped, buoyant body comprises a substantially short, flexible, columnar, buoyant body constructed from polyethylene expanded foam material, said substantially short, flexible columnar buoyant body further comprises said polyethylene expanded foam material having a coloring substance added to produce a colored, substantially short, flexible, columnar, buoyant body; and a port for receiving a terminal part of a human's limb, said port being centrally positioned on said buoyant body, said port defining a cavity sized for receiving the terminal part and facilitating a non-gripping securement of said buoyant body by an exerciser to enable a grip-free, resisted manipulation of said buoyant body in a water exercising environment, said columnar, buoyant body being sized larger when the terminal part is a foot than when the terminal part is a hand, said cavity comprises a rectangular shaped, tapered through-hole sized such that a height dimension associated with an entry side is larger than a height dimension associated with an exit side of said through-hole.

12. A resistance producing aquatic exercise apparatus as described in claim 11, wherein:

said tapered through-hole being sized such that an exerciser's hand may be received therein.

13. A resistance producing aquatic exercise apparatus as described in claim 11, wherein:

said tapered through-hole being sized such that an exerciser's foot may be received therein.

14. A method of producing resistance by an exerciser exercising in an aquatic environment using aquatic exercise equipment without exerting a gripping force on said aquatic exercise equipment, said method comprising the steps of:

(a) providing at least one, resistance producing aquatic exercise apparatus, said apparatus comprising:

a geometrically shaped, buoyant body; and a port for receiving a terminal part of the exerciser's limb, said port being centrally positioned on said buoyant body, said port defining a cavity sized for receiving the terminal part and facilitating a non-gripping securement of said buoyant body by said exerciser to enable a grip-free, resisted manipulation of said buoyant body in a water exercising environment, said cavity being a rectangular shaped, tapered through-hole sized such that a height dimension associated with an entry side is larger than a height dimension associated with an exit side of said through-hole;

(b) the exerciser selecting said provided aquatic exercise apparatus and preparing to exercise in said aquatic environment;

(c) the exerciser selecting an exerciser's foot for inserting into said port;

(d) inserting the exerciser's foot into said cavity; and (e) producing resistance by manipulating said buoyant body in said aquatic environment without said inserted terminal part having to exert a gripping force on said aquatic exercise equipment.

15. A method of producing resistance by an exerciser exercising in an aquatic environment using aquatic exercise equipment without exerting a gripping force on said aquatic exercise equipment, said method comprising the steps of:

(a) providing at least one pair of resistance producing aquatic exercise apparatus, each of said apparatus comprising:

a geometrically shaped, buoyant body; and a port for receiving a terminal part said port being centrally positioned on said buoyant body, said port defining a cavity sized for receiving the terminal part and facilitating a non-gripping securement of said buoyant body by said exerciser to enable a grip-free, resisted manipulation of said buoyant body in a water exercising environment, said cavity being a rectangular shaped, tapered through-hole sized such that a height dimension associated with an entry side is larger than a height dimension associated with an exit side of said through-hole;

(b) the exerciser selecting said provided pair of aquatic exercise apparatus and preparing to exercise in said aquatic environment;

(c) the exerciser selecting an exerciser's hand for inserting into said port on each apparatus;

(d) inserting the exerciser's hand into a respective one of said tapered through-holes associated with said provided pair of aquatic exercise apparatus; and (e) producing resistance by manipulating said buoyant body in said aquatic environment without each of the inserted terminal parts having to exert a gripping force on said aquatic exercise equipment.

* * * * *